US007487897B1

(12) United States Patent
O'Brien

(10) Patent No.: US 7,487,897 B1
(45) Date of Patent: Feb. 10, 2009

(54) EMERGENCY CONTACT HOLDER

(76) Inventor: Timothy P. O'Brien, 32535 Newcastle Dr., Warren, MI (US) 48093

( * ) Notice: Subject to any disclaimer, the term of this patent is extended or adjusted under 35 U.S.C. 154(b) by 314 days.

(21) Appl. No.: 11/114,495

(22) Filed: Apr. 26, 2005

Related U.S. Application Data

(60) Provisional application No. 60/569,571, filed on May 10, 2004.

(51) Int. Cl.
*A45C 1/04* (2006.01)
*A45F 3/04* (2006.01)

(52) U.S. Cl. ..... 224/669; 224/666; 224/667; 224/651

(58) Field of Classification Search ..... 224/666, 224/667, 651, 669
See application file for complete search history.

(56) References Cited

U.S. PATENT DOCUMENTS

| | | | | |
|---|---|---|---|---|
| 475,400 | A | 5/1892 | Houghton et al. | |
| 960,442 | A | 6/1910 | Thurley | |
| 1,553,199 | A * | 9/1925 | Stewart | 24/3.6 |
| 1,573,663 | A | 2/1926 | Warren | |
| 1,841,266 | A | 1/1932 | Jones | |
| D121,541 | S | 7/1940 | Lipic, Jr. | |
| 3,402,808 | A | 9/1968 | Yannuzzi | |
| 3,670,933 | A * | 6/1972 | Jones | 224/222 |
| 3,958,690 | A * | 5/1976 | Gee, Sr. | 206/232 |
| 4,333,562 | A | 6/1982 | Todd | 206/37 |
| 4,393,974 | A | 7/1983 | Levesque | 206/37 |
| 4,408,406 | A | 10/1983 | Barton | 40/19 |
| 4,577,753 | A | 3/1986 | Marhal | 206/232 |
| 4,704,770 | A * | 11/1987 | Minami et al. | 24/431 |
| 5,215,334 | A * | 6/1993 | Presson et al. | 283/76 |
| D349,602 | S | 8/1994 | Denault | |
| 5,501,171 | A | 3/1996 | Leake | |
| D381,805 | S * | 8/1997 | Case | D3/229 |
| 5,700,036 | A * | 12/1997 | Smith, III | 283/72 |
| 6,050,605 | A * | 4/2000 | Mikelionis et al. | 283/76 |
| D464,793 | S | 10/2002 | Anderton | D3/215 |
| 6,481,367 | B2 * | 11/2002 | McClosky | 116/235 |
| D527,891 | S * | 9/2006 | Hoeksema | D3/207 |
| 7,347,360 | B2 * | 3/2008 | Lasch et al. | 235/380 |
| 2004/0200869 | A1 * | 10/2004 | Toleman | 224/257 |

FOREIGN PATENT DOCUMENTS

| | | | |
|---|---|---|---|
| DE | 3001927 | A1 * | 1/1980 |
| FR | 2335014 | * | 8/1977 |

* cited by examiner

*Primary Examiner*—Nathan J Newhouse
*Assistant Examiner*—Lester L Vanterpool
(74) *Attorney, Agent, or Firm*—Young Basile

(57) ABSTRACT

An emergency information holder made of a pliable material having an elongate configuration with a clip secured at one end and a pocket formed at a second end. The pocket is configured to receive a flat strip of writable material. The pocket can be selectively opened and closed.

7 Claims, 1 Drawing Sheet

EMERGENCY CONTACT HOLDER

This application claims priority of personal Provisional Application Ser. No. 60/569,571, filed May 10, 2004 which is incorporated herein by reference.

BACKGROUND OF THE INVENTION

The present invention relates to an Emergency Contact Holder.

Runners, cyclists, and others who exercise following a specific route away from their homes have a need for carrying on their person a form of identification and emergency contact names and numbers in the event of an accident during their exercise routine. Many types of clothing worn by runners, cyclists, and others do not provide convenient pockets or other means for holding and securing the identity information and emergency contact information thereon.

Previous containers to hold emergency identification and contact information have been made from rigid material, such as metal or rigid plastic, which is not conducive for folding and storing in purse, wallet, or pocket when not in use. Further, the rigid-type containers require a cap or other type of rigid enclosure to seal the opening for placement of the identification and emergency contact information. This causes added cost to a rigid container. It is, therefore, desirable to provide an emergency contact holder that is pliable so that it is foldable, and simply made so that it is inexpensive to manufacture and capable of being stored in small compartments such as a wallet, purse or pocket.

SUMMARY OF THE INVENTION

The intent of the invention is to address the aforementioned concerns. The invention provides an emergency contact holder made of a flexible strap having a first and second end wherein the first end has a clipping means secured thereto for connection to an article of clothing on a person. A pocket is formed in the second end and has access thereto from the second end. The holder also provides means for selectively opening and closing the access to the pocket.

In another aspect of the invention, the emergency contact holder is a strap made of a woven, waterproof material.

In another aspect of the invention, the means for selectively opening and closing the access to the pocket includes complementary hook and eye portions engaged to inner surfaces of the pocket.

BRIEF DESCRIPTION OF THE DRAWINGS

The description herein makes reference to the accompanying drawings wherein like reference numerals refer to like parts throughout the several views, and wherein.

DESCRIPTION OF THE INVENTION

Figure 1:
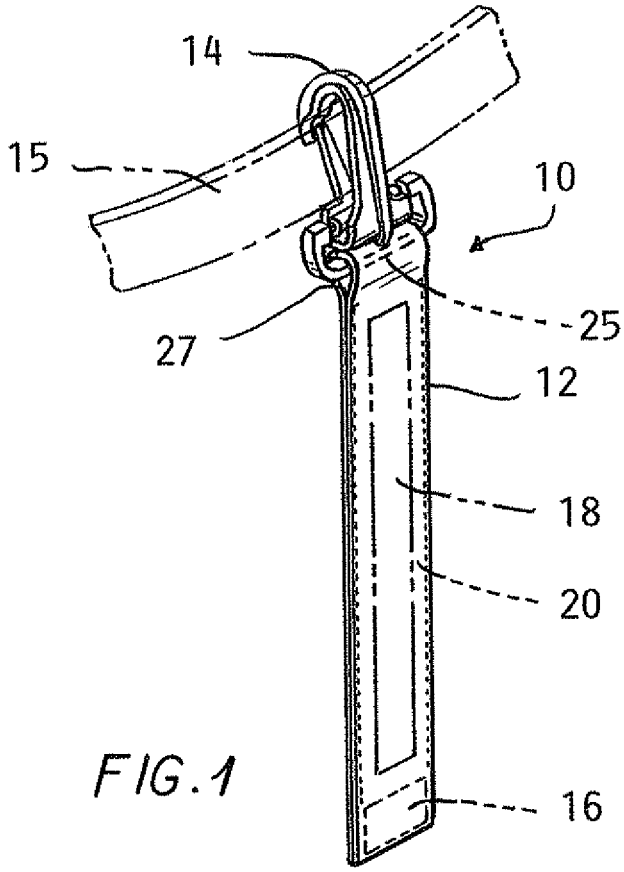
FIG. 1 is an perspective view showing one embodiment of the emergency contact holder according to the present invention attached to a belt.
Figure 2:
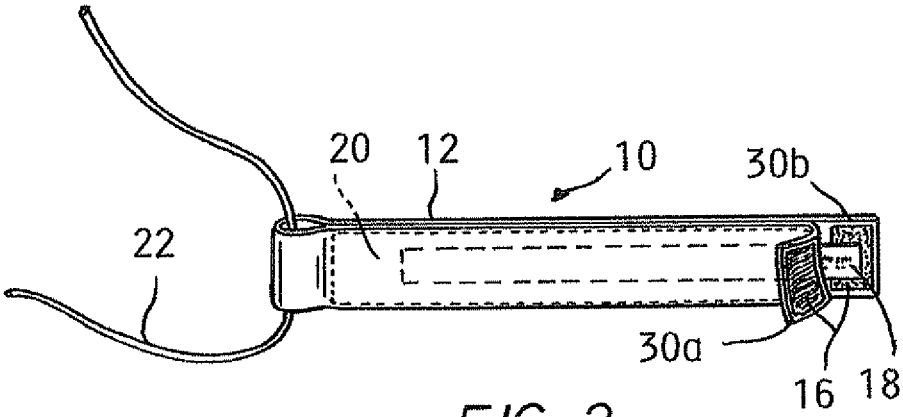
FIG. 2 is an elevational view showing a second embodiment of the invention.
Figure 3:
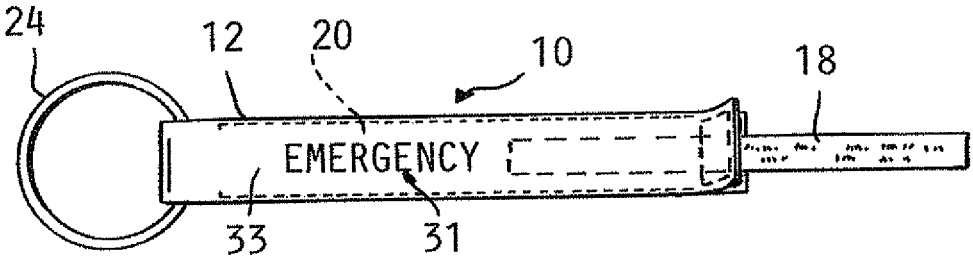
FIG. 3 is an elevational view showing a third embodiment of the invention.

In one embodiment, the emergency contact device 10 includes a pliable tube having a clip or other device for connecting the emergency contact holder 12 to a person's article of clothing or as shown in FIG. 1 to a belt 15. The clip 14 can be made of plastic, aluminum, steel, and any ferrous or non-ferrous material. The clip 14 can also be replaced with a drawstring 22, cord, ring 24, as shown in FIGS. 2 and 3, respectively, or any device that would releasably secure the holder 12 to the carrying object or person. The clip 14 can have a conventional spring lock, metal flapper, or any construction that will not allow the clip 14 to become detached from the carrying object or person. The clip 14 has a positive construction to enable the holder 12 to endure pulling, pushing, heat, cold, and still remain fastened to the clip 14 and secured to the carrying object or person.

The holder 12 can be made of molded, extruded, heat staked plastic, material such as canvas, Sunbrella®, nylon, polypropylene, polyurethane, or cotton type material. It is advantageous that the holder 12 is made of a pliable material so that the holder 12 can be folded to minimize its size. Therefore, it is preferable to have the holder made of a woven material. Further, it is preferable that the material is water proof or water resistant for durability. The pliable and foldable material allows the user to fold the holder 12 for placement in a clothing pocket, wallet or purse. The holder 12 can also be constructed of non-flexible material such as aluminum, steel, any ferrous or non-ferrous material, but would not offer the advantages of a flexible, foldable material. Raw material, such as plastic, can also be extruded to form a continuous tube that is cut to a desired length to form the holder 12.

The holder 12 may be a piece of material folded over and fused in such a manner that it forms the pocket or tubular cavity or hollow areas 20. The holder 12 is constructed in such a way as to form a pocket, tubular cavity, or hollow area 20 that would allow a document, or personal possession to be inserted into the holder 12.

The holder 12 may also be two pieces of material that are sewn together to form the tubular cavity 20. The holder 12 is attached to the clip 14, cord 22 or ring 24 in a positive manner that would not allow the holder 12 to become removed from the clip 14, cord 22, or ring 24. The attaching manner may be by means of a fold over a retention detail 25 on the clip 14 and sewn, heat staked or glued in such a secured manner it would not come loose from the clip 14. The clip end 27 of the holder 12 is sealed closed when it is attached to the clip. There is no opening or pocket at the clip end 27 to prevent a document or any other piece of material 18 from exiting the holder 12.

The opposing end 29 from the clip end 27 of the holder 12 can be selectively opened and closed and will allow a document 18 or personal possession to be inserted into the holder 12. Once a document 18 has been inserted into the holder 12, the second end 29 can then be securely closed and locked by a sealing means 16 that will not allow the document 18 inside the tubular cavity 20 to become dislodged and fall out. The sealing means can be opened only by the user or other person. The sealing means 16 can be a Velcro® type hook and loop strip attached to the two interior surfaces 30*a, b* of the holder 12 and pinched together, engaging the hook and loop mechanism to seal the access opening 29 closed. The selectively open end 29 can also be sealed closed by using other means such as buttons, snaps, or drawstrings.

The holder 12 can be in any color or designed graphics. For the purpose of an emergency device 10, it is preferably in a bright red. Emergency identification or other indicia 31 can be written on the exterior surface 33 of the holder to alert a passerby of the contents of the holder 12 when the owner is unable to speak.

The document 18 inside the holder 12 is a material that can retain emergency phone numbers or messages for use in the case of an emergency. The material can be made of paper, cardboard, plastic, ferrous or non-ferrous material on which a phone number or message can be written, engraved or stamped on. The document material can be a flexible or rigid, cut to the preference of the user, and be of a durable material so the phone number or message will not be lost over a long period of time.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An emergency information holder comprising:

a single flexible strap having a first and second terminating end, said strap folded over wherein the first and second terminating ends directly overlay each other and forming a double layer of the strap with an opposing folded end and a pair of double layer lateral peripheral edges;

said strap having a visible outer surface bearing indicia thereon indicating the strap being a holder of emergency contact information;

a connector secured in a space formed between the double layer at the opposing folded end configured to connect to an article of clothing on a person, said connector extending outwardly from the pair of lateral peripheral edges;

a selectively accessible pocket defined by the double layer fixedly secured together along the pair of lateral peripheral edges of the double layer between the opposing folded end and the overlaid first and second terminating ends and secured along a side parallel and adjacent to the folded end, wherein said space for the connector is disposed between the folded end and the secured side parallel and adjacent to the folded end;

a cavity disposed in the pocket between the double layer and extending from one secured lateral peripheral edge to the other secured lateral peripheral edge, said pocket having a single access to the cavity disposed between the pair of lateral peripheral edges; and a selectively opening and closing device attached to the strap at the first and second terminating ends, one portion of the selectively opening and closing device attached to one layer of the strap at the first terminating end and another portion of the selectively opening and closing device attached to the other layer of the strap at the second terminating end, said selectively opening end closing device configured to allow access to the cavity when in an open position and to prevent the contact information from falling out of the pocket when in a closed position, wherein the access to the pocket is at the opposite end from the connector, wherein when the selectively opening and closing device is in an open position the pair of lateral peripheral edges are fixedly secured together.

2. The holder of claim 1, wherein the strap is made of woven waterproof material.

3. The holder of claim 1, wherein the selectively opening and closing device includes complementary hook and eye portions engaged to inner surfaces of the double layer at the overlaid first and second terminating ends.

4. The holder of claim 1, wherein the emergency contact information includes a writable flat strip of material configured to fit into said cavity of the pocket.

5. An emergency information holder comprising:

an emergency contact information device having an outer visible surface and red in color, said outer surface bearing indicia of said device being a holder of emergency contact information;

said device pliable and folded upon itself forming a double layer with a folded edge at one end and an open opposing end, said device having a pocket and a single pocket access configured to accept an insertion of an article bearing emergency contact information into the pocket of said device, said pocket defined by the double layer secured together along opposing lateral edges and along a third portion adjacent the folded edge, said single pocket access located at the open opposing end;

said single pocket access being reversibly opened to insert emergency contact information into said pocket and being reversibly closed to prevent inserted emergency contact information from becoming dislodged from said device or falling out of said device wherein when the single pocket access is reversibly opened the lateral edges remain secured together;

said device secured to a connecting device configured to connect said device to a carrying object or a person forming a secure connection resistant to pulling and pushing forces;

said connecting device operable to allow said secure connection to be reversed to disconnect said device from said carrying object or person by an affirmative act by a person to cause a disconnection of said holder from said carrying object or person;

having a portion disposed in a space in the device between the folded edge and the secured third portion, said connecting device having another portion extending outwardly from the space through the opposing lateral edges at locations between the folded edge and the secured third portion.

6. An emergency information holder comprising:

a flexible pocket defined by a double layer of foldable material with a first layer overlaying a second layer and connected at a folded loop end and secured together along three contiguous sides and a fourth open side defining a border of the pocket, the three secured sides including a pair of parallel lateral sides and a middle side extending between each of the lateral sides, said secured middle side is spaced from the folded looped end defining a gap between the secured middle side and the folded looped end, said gap having access thereto via side openings in the pair of parallel lateral sides, the pocket having a cavity disposed between the double layer of material within the border of the pocket and extending from one lateral side to the other lateral side, the pocket having an access to the cavity through the fourth open side of the pocket, said fourth side opposing the middle side of the pocket, the double layer of material extending to a looped portion located adjacent to the middle side and spaced from the border of the pocket;

said fourth open side defined by a terminating end of the first layer overlaying a terminating end of the second layer, said pair of lateral sides and the fourth open side define peripheral edges of the holder;

a connector disposed and secured in the gap between the secured middle side and the folded loop end, said connector configured to connect to a carrying object and to provide a secure connection resistant to pulling and pushing forces, said connector having portions extending from the side openings in the pair of parallel lateral sides; and a selectively opening and closing device attached to the fourth side of the pocket configured to allow access into the cavity when in an open position and to prevent access to the cavity when in a closed position wherein when the selectively opening and closing device is in the open position the pair of parallel lateral sides remain secured together.

7. The emergency contact information holder of claim 6, wherein the portions of the connector extending from the side openings are connected to a clasp configured to connect to an article or person.

* * * * *